US005654118A

United States Patent [19]

Yuh et al.

[11] Patent Number: 5,654,118

[45] Date of Patent: Aug. 5, 1997

[54] IMAGING MEMBER INCLUDING A BLOCKING LAYER CONTAINING AN ENRICHED AMOUNT OF NICKEL HYDROXIDE

[75] Inventors: Huoy-Jen Yuh, Pittsford; William G. Herbert, Williamson; Alexandra I. Marcu; Philip G. Perry, both of Webster, all of N.Y.

[73] Assignee: Xerox Corporation, Stamford, Conn.

[21] Appl. No.: 679,919

[22] Filed: Jul. 15, 1996

[51] Int. Cl.[6] ..... G03G 5/14

[52] U.S. Cl. ..... 430/58; 430/65

[58] Field of Search ..... 430/58, 65

[56] References Cited

U.S. PATENT DOCUMENTS

| | | | |
|---|---|---|---|
| 3,907,650 | 9/1975 | Pinsler | 204/34 |
| 3,914,126 | 10/1975 | Pinsler | 96/1.5 |
| 4,013,463 | 3/1977 | Leder | 96/1.5 |
| 4,098,655 | 7/1978 | Ward et al. | 204/38 A |
| 4,557,993 | 12/1985 | Matyjakowski | 430/131 |
| 5,114,818 | 5/1992 | Yu | 430/97 |
| 5,215,853 | 6/1993 | Andrews et al. | 430/131 |
| 5,244,760 | 9/1993 | Nealey et al. | 430/59 |

*Primary Examiner*—John Goodrow

*Attorney, Agent, or Firm*—Zosan S. Soong

[57] ABSTRACT

There is disclosed an electrostatographic imaging member comprising: (a) a substrate; (b) a charge blocking layer comprised of nickel hydroxide and nickel oxide, wherein the nickel hydroxide content is at least about 10% based on the number of the nickel hydroxide and the nickel oxide molecules; and (c) a least one imaging layer.

10 Claims, 1 Drawing Sheet

IMAGING MEMBER INCLUDING A BLOCKING LAYER CONTAINING AN ENRICHED AMOUNT OF NICKEL HYDROXIDE

BACKGROUND OF THE INVENTION

This invention relates to an imaging member (also referred herein as a photoreceptor) which includes a blocking layer containing an enriched concentration of nickel hydroxide. Such an imaging member is employed in for example an electrostatographic printing or copying apparatus.

There are numerous applications in the electrophotographic art wherein a coherent beam of radiation, typically from a helium-neon or diode laser is modulated by an input image data signal. The modulated beam is directed (scanned) across the surface of a photosensitive medium. The medium can be, for example, a photoreceptor drum or belt in a xerographic printer or copier, a photosensor CCD array, or a photosensitive film. Certain classes of photosensitive medium which can be characterized as "layered photoreceptors" have at least a partially transparent photosensitive layer overlying a conductive ground plane (which is part of a substrate). A problem inherent in using these layered photoreceptors, depending upon the physical characteristics, is the creation of dominant reflections of the incident coherent light on the surface of the photoreceptor which can give rise to optical interference effects. This condition is shown in FIG. 1 where coherent beams 1 and 2 are incident on a layered photoreceptor 6 comprising a charge transport layer 7, charge generating layer 8, and a ground plane 9. When the difference in the optical indices (i.e., the refractive index and the absorption constant) of the charge transport layer 7 and the charge generating layer 8 is large, one dominant reflection is at the interface between the charge transport layer 7 and the charge generating layer 8. There is a second dominant reflection from the top surface of layer 7. Depending on the optical path difference as determined by the thickness and index of refraction of layer 7, beams 1 and 2 can interfere constructively or destructively when they combine to form beam 3. When the additional optical path traveled by beam 1 (dashed rays) is an integer multiple of the wavelength of the light, constructive interference occurs, more light is reflected from the top of charge transport layer 7 and, hence, less light is absorbed by charge generating layer 8. Conversely, a path difference producing destructive interference means less light is lost out of the layer and more absorption occurs within the charge generating layer 8. The difference in absorption in the charge generating layer 8, typically due to layer thickness variations within the charge transport layer 7, is equivalent to a spatial variation in exposure on the surface. This spatial exposure variation present in the image formed on the photoreceptor becomes manifest in the output copy derived from the exposed photoreceptor. The pattern of light and dark interference fringes produced within a photoreceptor of the type shown in FIG. 1 when illuminated by for example a He-Ne laser with an output wavelength of 633 ran look like the grains on a sheet of plywood. Hence the term "plywood effect" is generically applied to this problem.

The conventional solutions to minimize the optical interference effects are problematic. For example, when the substrate surface is roughened to minimize the optical interference effects, the charge blocking layer typically has to be thick enough to completely cover (i.e., without bare patches) the substrate due to its surface roughness to prevent print defects caused by charge leakage from the substrate into the imaging member during the printing cycle. A relatively thick charge blocking layer which can be as thick as several microns may be undesirable in certain embodiments due to higher residual voltage.

There is a need, which the present invention addresses, for a charge blocking layer which can uniformly coat a substrate surface even at a relatively thin thickness and exhibits good charge blocking characteristics in a photoreceptor.

Conventional electrolytic techniques to form a metal oxide layer on a metal surface generally forms a mixture of a metal oxide and a metal hydroxide. However, it is believed that the amount of the metal hydroxide in the metal oxide layer resulting from the conventional techniques ranges from about 1% to about 5% (based on the number of the metal oxide and metal hydroxide molecules in the layer), the balance being the metal oxide.

The following documents disclose the use of a nickel oxide layer in an imaging member: Pinsler, U.S. Pat. No. 3,914,126, Pinsler, U.S. Pat. No. 3,907,650, Matyjakowski, U.S. Pat. No. 4,557,993, Leder, U.S. Pat. No. 4,013,463, and Ward et at., U.S. Pat. No. 4,098,655. In addition, Andrews et al., U.S. Pat. No. 5,215,853, discloses a layered photosensitive imaging member that is modified to minimize optical interference effects where the modification described is to form the ground plane surface by an electroforming process which leaves the surface with a black finish such as a black nickel layer.

SUMMARY OF THE INVENTION

There is provided an electrostatographic imaging member comprising:

(a) a substrate;

(b) a charge blocking layer comprised of nickel hydroxide and nickel oxide, wherein the nickel hydroxide content is at least about 10% based on the number of the nickel hydroxide and the nickel oxide molecules; and (c) at least one imaging layer.

DETAILED DESCRIPTION

Figure 1:
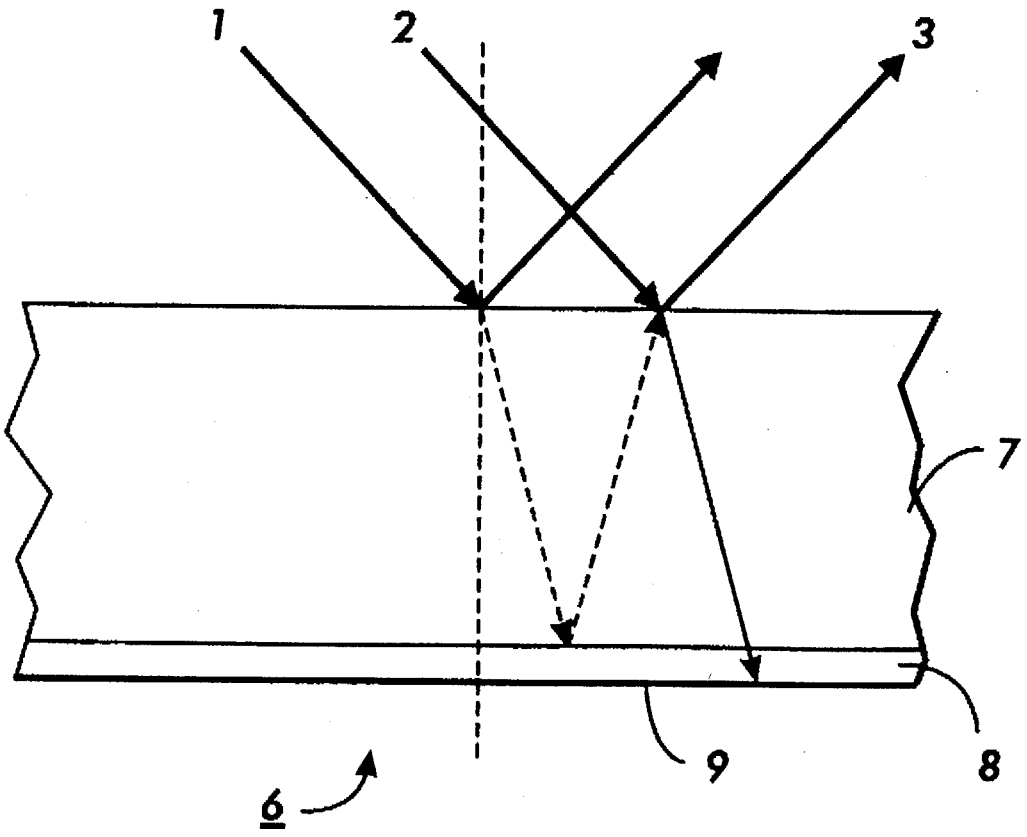
FIG. 1 PRIOR ART
FIG. 1 shows coherent light incident upon a prior art layered photosensitive member leading to reflections internal to the member.

A preferred structure of the imaging member is as follows: a substrate having an electrically conductive surface, a blocking layer over the substrate conductive surface, a charge generating layer over the blocking layer, a charge transport layer over the charge generating layer. The imaging member may also include one or more additional layers typically employed in a photoreceptor including for example an adhesive layer, an anticurl layer, and an overcoat layer. In alternate embodiments of the present invention, the charge transport layer is adjacent to blocking layer with the charge generating layer over the transport layer.

A description of suitable materials for the imaging member of the present invention follows.

THE SUBSTRATE

The substrate can be formulated entirely of an electrically conductive material, or it can be an insulating material having an electrically conductive surface. The substrate can be opaque or substantially transparent and can comprise numerous suitable materials having the desired mechanical properties. The entire substrate can comprise the same material as that in the electrically conductive surface or the electrically conductive surface can merely be a coating on the substrate. Any suitable electrically conductive material can be employed. Typical electrically conductive materials include metals like copper, brass, nickel, magnesium, gallium, zinc, chromium, stainless steel; and conductive plastics and rubbers, aluminum, semitransparent aluminum, steel, cadmium, titanium, silver, gold, paper rendered conductive by the inclusion of a suitable material therein or through conditioning in a humid atmosphere to ensure the presence of sufficient water content to render the material conductive, indium, tin, metal oxides, including tin oxide and indium tin oxide, and the like. The substrate layer can vary in thickness over substantially wide ranges depending on the desired use of the photoconductive member. Generally, the conductive layer ranges in thickness of from about 50 Angstroms to 10 centimeters, although the thickness can be outside of this range. When a flexible electrophotographic imaging member is desired, the substrate thickness typically is from about 0.015 mm to about 0.15 mm. The substrate can be fabricated from any other conventional material, including organic and inorganic materials. Typical substrate materials include insulating nonconducting materials such as various resins known for this purpose including polycarbonates, polyamides, polyurethanes, paper, glass, plastic, polyesters such as MYLAR® (available from DuPont) or MELINEX 447® (available from ICI Americas, Inc.), and the like. If desired, a conductive substrate can be coated onto an insulating material. In addition, the substrate can comprise a metallized plastic, such as titanized or aluminized MYLAR®. The coated or uncoated substrate can be flexible or rigid, and can have any number of configurations such as a cylindrical drum, an endless flexible belt, and the like.

Preferably, the substrate is fabricated by an electrodeposition process including electroplating or electroforming. Electrodeposition processes, such as electroforming processes, are illustrated in Bailey et at., U.S. Pat. No. 3,844,906, and Herbert, U.S. Pat. No. 4,501,646, the disclosures of which are totally incorporated by reference. The substrate is preferably electroformed nickel.

The substrate optionally may have a roughened substrate surface to minimize or eliminate optical interference effects due to exposure of the imaging member to monochromatic light. The roughness of a particular surface may be defined by several parameters, $R_a$ (mean roughness), $R_t$ (maximum roughness depth), $R_{pm}$ (mean levelling depth), $W_t$ (waviness depth), and $P_t$ (profile depth), the definitions of which are well known. $R_a$ is the arithmetic average of all departures of the roughness profile from the mean line within the evaluation length and in embodiments may be any value effective for substantially suppressing the plywood effect, preferably ranging from about 0.05 to about 0.7 micron, more preferably from about 0.1 to about 0.6 micron, and most preferably from about 0.10 to about 0.55 micron. In embodiments, $R_a$ has a value of from about lambda/4N to about lambda/2N, wherein lambda is the wavelength of the light source which is directed (scanned) across the surface of the photoreceptor and is from about 600 nm to about 900 nm, preferably from about 650 nm to about 800 nm, and N is an optical index of the photosensitive coatings and has a value from about 1 to about 3, and preferably from about 1.2 to about 2.0. $R_t$ is the vertical distance between the highest peak and the lowest valley of the roughness profile R within the evaluation length and in embodiments may be any value effective for substantially suppressing the plywood effect, preferably ranging from about 0.5 to about 6 microns, and more preferably from about 0.8 to about 4.5 microns. $R_{pm}$ is the mean of five levelling depths of five successive sample lengths and in embodiments may be any value effective for substantially suppressing the plywood effect, preferably ranging from about 0.2 to about 2 microns, and more preferably from about 0.3 to about 1.5 microns. $W_t$ is the vertical distance between the highest and lowest points of the waviness profile W within the evaluation length and in embodiments may be any value effective for substantially suppressing the plywood effect, preferably ranging from about 0.1 to about 1 micron, and more preferably from about 0.15 to about 0.5 micron. $P_t$ is the distance between two parallel lines enveloping the profile within the evaluation length at their minimum separation and in embodiments may be any value effective for substantially suppressing the plywood effect, preferably ranging from about 0.8 to about 6 microns, and more preferably from about 1 to about 4 microns. Significant plywood effect suppression may be observed in embodiments of the present invention at the light source wavelengths conventionally used, including a light source having a wavelength at 780 nm.

The surface roughness parameters, $R_a$, $R_t$, $R_{pm}$, $W_t$, and $P_t$, can be determined by a Perthen Surface Profilometer Model #S8P, available from Mahr Feinpruef Corp., by utilizing a 5 micron radius contact probe which rides over the surface and directly, by contact, measures the surface contour. An alternate attachment for the Perthen Surface Profilometer Model #S8P can measure the surface by projecting a laser beam onto the surface and measuring the change in focal length observed as the beam scans across the surface. It is understood that other devices and methods equivalent to those disclosed herein may also be employed to measure the various surface roughness parameters.

The substrate surface can be roughened by any suitable technique such as the application of a rotating fibrous wheel, disclosed in Swain, U.S. Pat. No. 5,302,485, the disclosure of which is totally incorporated by reference. Liquid honing, which involves spraying the substrate with a mixture of water and abrasive particles, can also be employed to roughen the substrate surface.

THE CHARGE BLOCKING LAYER

The charge blocking layer of the present invention preferably is a hole blocking layer capable of forming a barrier to prevent hole injection from the electrically conductive substrate to the photoconductive layer while allowing passage of electrons.

The charge blocking layer comprises nickel hydroxide and nickel oxide, wherein the nickel hydroxide content may be at least about 10%, preferably at least about 30%, more preferably from about 50% to about 95%, and especially from about 60% to about 90%. The nickel hydroxide content is based on the number of the nickel hydroxide and the nickel oxide molecules in the blocking layer. The hydroxide and oxide contents can be determined by conventional ESCA (electron spectroscopy chemical analysis) method which studies the surface of the layer by x-ray. The inner electrons on the surface of the layer are released and can be detected by electron spectrometer. The content of the blocking layer can be analyzed by etching down the layer with ion beams. The nickel hydroxide is believed to be in the form of $Ni_x(OH)_{2x}$ where x may be for example 1. The nickel oxide is believed to be in the form of $Ni_xO_y$ such as $Ni_2O_3$, $Ni_3O_4$, and $NiO_2$.

The blocking layer may have a thickness ranging for example from 10 angstroms to about 3 microns. The blocking layer thickness in embodiments is submicron such as from about 10 to about 60 angstroms. In embodiments, as one technique to suppress the plywood effect, the blocking layer can have an increased thickness ranging from about 1 micron to about 3 microns, preferably from about 1.5 micron to about 2 micron. Typically, the surface roughness increases with increasing blocking layer thickness where the rougher surface diffuses light more, thereby minimizing the plywood effect. This technique of an increased blocking layer thickness to suppress the plywood effect may be used where the substrate has a smooth surface or a roughened surface. A thicker blocking layer may not be required when using a substrate having a roughened surface. The blocking layer preferably has a substantially uniform thickness.

The nickel hydroxide containing blocking layer eliminates the need for an additional blocking layer using conventional materials, thereby reducing the cost and steps needed to fabricate the imaging member. However, it may be desired in certain embodiments of the present invention to have an additional charge blocking layer fabricated from the following conventional materials: polymers such as polyvinylbutyral, epoxy resins, polyesters, polysiloxanes, polyamides, polyurethanes and the like, or may be nitrogen containing siloxanes or nitrogen containing titanium compounds such as trimethoxysilyl propylene diamine, hydrolyzed trimethoxysilyl propyl ethylene diamine, N-beta-(aminoethyl) gamma-amino-propyl trimethoxy silane, isopropyl 4-aminobenzene sulfonyl, di(dodecylbenzene sulfonyl) titanate, isopropyl di(4-aminobenzoyl)isostearoyl titanate, isopropyl tri(N-ethylamino-ethylamino)titanate, isopropyl trianthranil titanate, isopropyl tri(N,N-dimethyl-ethylamino)titanate, titanium-4-amino benzene sulfonate oxyacetate, titanium 4-aminobenzoate isostearate oxyacetate, $(H_2N(CH_2)_4)CH_3Si(OCH_3)_2$, gamma-aminobutyl) methyl diethoxysilane, and $(H_2N(CH_2)_3)CH_3Si(OCH_3)_2$, (gamma-aminopropyl)-methyl diethoxysilane, as disclosed in U.S. Pat. Nos. 4,338,387, 4,286,033 and U.S. Pat. No. 4,291,110. Other suitable hole blocking layer polymer compositions are also described in U.S. Pat. No. 5,244,762. These include vinyl hydroxyl ester and vinyl hydroxy amide polymers wherein the hydroxyl groups have been partially modified to benzoate and acetate esters which modified polymers are then blended with other unmodified vinyl hydroxy ester and amide unmodified polymers. An example of such a blend is the 30 mole percent benzoate ester of poly(2-hydroxyethyl methacrylate) blended with the parent polymer poly(2-hydroxyethyl methacrylate). A preferred conventional charge blocking layer or undercoat layer is nylon 8 or acetylacetone zirconium tributoxide and gammaaminopropyltrimethoxysilane.

The substrate optionally has a roughened surface as described herein to minimize or eliminate the optical interference effects associated with monochromatic laser light. A thicker blocking layer in microns is conventionally needed in order to have complete coverage over the substrate due to surface roughness. Since conventional blocking layer materials cannot transport electrons efficiently, the thicker blocking layer causes higher residual voltage which may be undesirable. With the present invention, however, the thickness of the nickel hydroxide enriched blocking layer is not required to be over 1 micron and can be submicron in thickness since the nickel hydroxide enriched blocking layer can be formed uniformly (i.e., the absence of bare patches of exposed substrate due to the surface roughness) on the substrate surface with a controlled thickness. Therefore, the residual voltage of the thin nickel hydroxide enriched blocking layer would be low.

There are a number of ways to form the enriched nickel hydroxide blocking layer with complete coverage of the substrate surface even at a thin thickness such as a submicron thickness. For instance, where an electroformed nickel substrate is employed (the degree of surface roughness may be controlled by the electroforming process), the humidity in the post electroform drying oven may be controlled to increase the nickel hydroxide content on the substrate surface. Saturated salt solutions are maintained in the drying oven during the post nickel electroforming drying step and the type of salt solution and the temperature determine the resulting humidity. The time in the humidified oven and the temperature determine how much nickel hydroxide is formed; for example increasing the humidity will generally increase the nickel hydroxide content. Another suitable method involves changing the potential in the nickel electroforming bath just before the nickel substrate (i.e., the electroform) is removed: make the elctroform anodic (½ cell potential of 0.400 V) for 30 seconds, then cathodic (½ cell potential of 0.750 V for 2 seconds); the time at these two conditions can be changed to change the thickness of the blocking layer; and the voltage can be changed to change the ratio of nickel oxide to nickel hydroxide.

A submicron blocking layer containing enriched nickel hydroxide may exhibit good charge blocking characteristics, but may be of insufficient thickness to minimize or eliminate the optical interference effects when the imaging member is exposed to monochromatic laser light. To make a thicker enriched nickel hydroxide blocking layer (e.g., over 1 micron in thickness), which may eliminate the optical interference effects, the substrate is placed in a nickel plating bath and the enriched nickel hydroxide blocking layer is electrolytically formed on the substrate as illustrated herein. Such a thicker nickel hydroxide blocking layer exhibits good charge blocking characteristics without the tradeoff on the increased residual voltage. No heat drying is generally necessary after the formation of the nickel hydroxide enriched blocking layer as conventionally required for a solvent coated blocking layer. Only water rinsing of the blocking layer surface may be sufficient after the formation of the nickel hydroxide enriched blocking layer.

It is believed that a photoreceptor having less than 10% nickel hydroxide content in the charge blocking layer will not take a high enough charge to be useful as a xerographic device. In contrast, a photoreceptor having at least about 10% nickel hydroxide content in the charge blocking layer will take a high enough charge to be useful as a xerographic device and will discharge appropriately when exposed to light.

THE ADHESIVE LAYER

An intermediate layer between the blocking layer and the adjacent charge generating or photogenerating layer may be desired to promote adhesion. For example, the adhesive layer preferably has a dry thickness between about 0.001 micrometer to about 0.2 micrometer. Typical adhesive layers include film-forming polymers such as polyester, du Pont 49,000 resin (available from E. I. du Pont de Nemours & Co.). VITEL-PE100™ (available from Goodyear Rubber & Tire Co.), polyvinylbutyral, polyvinylpyrrolidone, polyurethane, polymethyl methacrylate, and the like.

THE IMAGING LAYER(S)

The imaging layer or layers may comprise for example a photoconductive material and a charge transport material in the same layer or different layers. Illustrative photoreceptors, charge generating materials, charge transport materials, and photoreceptor fabrication techniques are disclosed in for example in U.S. Pat. Nos. 4,265,990; 4,390,611; 4,551,404; 4,588,667; 4,596,754; 4,797,337; 4,965,155; and U.S. Pat. No. 5,004,662, the disclosures of which are totally incorporated by reference.

The photoconductive material is capable in embodiments of generating electronic charge carriers in response to the absorption of radiation to be recorded by the imaging photoreceptor. The photoconductive material may be any suitable organic or inorganic photoconductor. Illustrative organic photoconductive charge generating materials include azo pigments such as Sudan Red, Dian Blue, lanus Green B, and the like; quinone pigments such as Algol Yellow, Pyrene Quinone, Indanthrene Brilliant Violet RRP, and the like; quinocyanine pigments; perylene pigments; indigo pigments such as indigo, thioindigo, and the like; bisbenzoimidazole pigments such as Indofast Orange toner, and the like; phthalocyanine pigments such as copper phthalocyanine, aluminochloro-phthalocyanine, and the like; quinacridone pigments; or azulene compounds. Suitable inorganic photoconductive materials include for example cadlure sulfide, cadmium sulfoselenide, cadmium selenide, crystalline and amorphous selenium, lead oxide and other chalcogenides. Alloys of selenium are encompassed by embodiments of the instant invention and include for instance selenium-arsenic, selenium-tellurium-arsenic, and selenium-tellurium.

Any suitable inactive resin binder material may be employed in the charge generating layer. Typical organic resinous binders include polycarbonates, acrylate polymers, methacrylate polymers, vinyl polymers, cellulose polymers, polyesters, polysiloxanes, polyamides, polyurethanes, epoxies, polyvinylacetals, and the like.

Charge transport materials include an organic polymer or non-polymeric material capable of supporting the injection of photoexcited holes or transporting electrons from the photoconductive material and allowing the transport of these holes or electrons through the organic layer to selectively dissipate a surface charge. Illustrative charge transport materials include for example a positive hole transporting material selected from compounds having in the main chain or the side chain a polycyclic aromatic ring such as anthracene, pyrene, phenanthrene, coronene, and the like, or a nitrogen-containing hetero ring such as indole, carbazole, oxazole, isoxazole, thiazole, imidazole, pyrazole, oxadiazole, pyrazoline, thiadiazole, triazole, and hydrazone compounds. Typical hole transport materials include electron donor materials, such as carbazole; N-ethyl carbazole; N-isopropyl carbazole; N-phenyl carbazole; tetraphenylpyrene; 1-methyl pyrene; perylene; chrysene; anthracene; tetraphene; 2-phenyl naphthalene; azopyrene; 1-ethyl pyrene; acetyl pyrene; 2,3-benzochrysene; 2,4-benzopyrene; 1,4-bromopyrene; poly (N-vinylcarbazole); poly(vinylpyrene); poly(-vinyltetraphene); poly(vinyltetracene) and poly (vinylperylene). Suitable electron transport materials include electron acceptors such as 2,4,7-trinitro-9-fluorenone; 2,4,5,7-tetranitro-fluorenone; dinitroanthracene; dinitroacridene; tetracyanopyrene and dinitroanthraquinone.

Any suitable inactive resin binder may be employed in the charge transport layer. Typical inactive resin binders soluble in methylene chloride include polycarbonate resin, polyvinylcarbazole, polyester, polyarylate, polystyrene, polyacrylate, polyether, polysulfone, and the like. Molecular weights can vary from about 20,000 to about 1,500,000.

Any suitable technique may be utilized to apply the charge transport layer and the charge generating layer. Typical application techniques include spraying, dip coating, roll coating, wire wound rod coating, and the like. Drying of the deposited coating may be effected by any suitable conventional technique such as oven drying, infrared radiation drying, air drying and the like. Generally, the thickness of the charge generating layer ranges from about 0.1 micron to about 3 microns and the thickness of the transport layer is between about 5 microns to about 100 microns, but thicknesses outside these ranges can also be used. In general, the ratio of the thickness of the charge transport layer to the charge generating layer is preferably maintained from about 2:1 to 200:1 and in some instances as great as 400:1.

The invention will now be described in detail with respect to specific preferred embodiments thereof, it being understood that these examples are intended to be illustrative only and the invention is not intended to be limited to the materials, conditions or process parameters recited herein. All percentages and parts are by weight unless otherwise indicated.

EXAMPLE 1

Nickel hydroxide enriched blocking layers were prepared by applying 1V constant voltage to two nickel drum substrates in 1% by weight potassium hydroxide solution at 23 degrees C. with the pH adjusted to 7.5, one for 5 minutes and the other one for 20 minutes. The two nickel substrates, having a 5 mil wall thickness, were nonreflective but fairly smooth (about 15 microinch RMS) and were electroformed. After the treatment, the surfaces of the two Ni drums were rinsed with deionized water and the surface of each drum had a uniform appearance with no bare patches exposing substrate surface. The two treated Ni drums, along with another untreated Ni drum (identical to the two treated Ni drums) as a control, were each coated with the same charge generating layer ("CGL") and the same charge transport layer ("CTL") in the same manner. The CGLs were coated from a 3% solid content dispersion of metal free phthalocyanine pigment dispersed in polyvinylbutyral binder (the pigment/binder ratio was 64/36 by wt) in cyclohexanone and dried at 100° C. for 10 min. The dried charge generating layer on each substrate was about 0.2 micron thick. The CTLs were coated from a 20% solid content solution of N,N'-diphenyl-N,N'-bis(3-methylphenyl)-[1,1'-biphenyl]-4,4'diamine and polycarbonate Z200 in monochlorobenzene in a 35/65 ratio of the dinmine to the polycarbonate. The CTL coatings were dried at 130° C. for 60 minutes. The dried charge transport layer on each substrate was about 20 microns thick. The three photoreceptor samples were tested in a cyclic scanner. The devices were charged to a constant voltage of 380 V by a scorotron. The surface voltages (Vddp) were measured 0.19 sec after the charging. The surface charges were then erased with the exposure of the devices to light. If the device has poor charge blocking, holes will inject into the photoreceptor from the substrate and lower the Vddp value. The hydroxide surface treatment had increased Vddp surface charge. Without any treatment, the Vddp of the control photoreceptor was only 312 V. With treatment, the surface charge was increased to 367 V for 5 minutes treatment for the first inventive photoreceptor and 373 V for 20 minutes treatment for the second inventive photoreceptor.

Thus, it appeared that the longer the treatment, the better the charge blocking. The treated nickel surfaces were also analyzed with ESCA. The precise mixture of nickel oxide and nickel hydroxide formed on the Ni surface depended on the treatment condition. The nickel hydroxide content increased with lower applied voltage and increased with the treatment time. At the treatment of 1 V and 20 minutes, over 50% of the molecules were nickel hydroxide in the blocking layer, the balance being nickel oxide. At the treatment of 1 V and 5 minutes, only about 20% of the molecules were nickel hydroxide in the blocking layer, the balance being nickel oxide.

Other modifications of the present invention may occur to those skilled in the art based upon a reading of the present disclosure and these modifications are intended to be included within the scope of the present invention.

We claim:

1. An electrostatographic imaging member comprising:

(a) a substrate;

(b) a charge blocking layer comprised of nickel hydroxide and nickel oxide, wherein the nickel hydroxide content is at least about 10% based on the number of the nickel hydroxide and the nickel oxide molecules; and (c) at least one imaging layer.

2. The member of claim 1, wherein the substrate is a metal selected from the group consisting of nickel, aluminum, titanium, magnesium, gallium, and zinc.

3. The member of claim 1, wherein the substrate is electroformed nickel.

4. The member of claim 1, wherein the nickel hydroxide content of the blocking layer is at least about 30%.

5. The member of claim 1, wherein the nickel hydroxide content of the blocking layer ranges from about 50% to about 95%.

6. The member of claim 1, wherein the nickel hydroxide content of the blocking layer ranges from about 60% to about 90%.

7. The member of claim 1, wherein there is absent a second charge blocking layer.

8. The member of claim 1, wherein the blocking layer has a thickness ranging from about 1 micron to about 3 microns, wherein the thickness is effective for minimizing any optical interference effects within the member resulting from exposure of the member to monochromatic laser light.

9. The member of claim 1, wherein the blocking layer has a submicron thickness.

10. The member of claim 1, wherein the at least one imaging layer comprises a charge generating layer and a charge transport layer.

* * * * *